US006662595B2

(12) United States Patent
Corduan et al.

(10) Patent No.: US 6,662,595 B2
(45) Date of Patent: Dec. 16, 2003

(54) PROCESS AND DEVICE FOR OBTAINING A COMPRESSED PRODUCT BY LOW TEMPERATURE SEPARATION OF AIR

(75) Inventors: Horst Corduan, Puchheim (DE); Dietrich Rottmann, Munich (DE); Christian Kunz, Munich (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 10/217,329

(22) Filed: Aug. 13, 2002

(65) Prior Publication Data

US 2003/0051504 A1 Mar. 20, 2003

(30) Foreign Application Priority Data

Aug. 13, 2001 (DE) ..... 101 39 727

(51) Int. Cl.[7] ..... F25J 3/04
(52) U.S. Cl. ..... 62/646; 62/654
(58) Field of Search ..... 62/646, 654

(56) References Cited

U.S. PATENT DOCUMENTS

| | | | | |
|---|---|---|---|---|
| 5,341,646 A | * | 8/1994 | Agrawal et al. | 62/654 |
| 5,456,083 A | * | 10/1995 | Hogg et al. | 62/654 |
| 5,628,207 A | * | 5/1997 | Howard et al. | 62/654 |
| 5,655,388 A | | 8/1997 | Bonaquist et al. | |

FOREIGN PATENT DOCUMENTS

| | | |
|---|---|---|
| DE | 2680114 | 2/1993 |
| DE | 19803437 | 3/1999 |
| EP | 0547946 | 6/1993 |
| EP | 0660058 | 6/1995 |
| EP | 0698772 | 2/1996 |
| FR | 2778971 | 11/1999 |

* cited by examiner

*Primary Examiner*—William C. Doerrler
(74) *Attorney, Agent, or Firm*—Millen, White, Zelano, Branigan, P.C.

(57) ABSTRACT

The process and device are used to obtain a compressed product by low temperature separation of air in a rectification system which has a pressure column and a low pressure column. A first flow of compressed and purified feedstock air is cooled in a main heat exchanger system and is fed into the pressure column. At least one fraction from the pressure column is expanded and fed into the low pressure column. An oxygen-rich fraction from the low pressure column is liquid-pressurized and delivered to a mixing column. A heat exchange medium is fed into the lower area of the mixing column and is brought into countercurrent contact with the oxygen-rich fraction. A gaseous top product is removed from the upper area of the mixing column. A product fraction is removed from the rectification system, liquid-pressurized, vaporized in indirect heat exchange with the gaseous top product of the mixing column and is withdrawn as the compressed product. Indirect heat exchange is carried out for vaporization of the liquid-pressurized product fraction in the main heat exchanger system.

26 Claims, 10 Drawing Sheets

PROCESS AND DEVICE FOR OBTAINING A COMPRESSED PRODUCT BY LOW TEMPERATURE SEPARATION OF AIR

The invention relates to a process for obtaining a compressed product by low temperature separation of air in a rectification system which has a pressure column (high pressure column) and a low pressure column, this process comprising the following steps:

a. a first flow of compressed and purified feedstock air is cooled in a main heat exchanger system and is fed into the pressure column, b. at least one fraction from the pressure column is expanded and fed into the low pressure column, c. an oxygen-rich fraction from the low pressure column is liquid-pressurized and delivered to the mixing column, d. a heat exchange medium is fed into the lower area of the mixing column and is brought into countercurrent contact with the oxygen-rich fraction, e. a gaseous top product is removed from the upper area of the mixing column and f. a product fraction is removed from the rectification system, liquid-pressurized, vaporized in indirect heat exchange with the gaseous top product of the mixing column and is withdrawn as the compressed product, characterized in that g. indirect heat exchange is carried out for vaporization of the liquid-pressurized product fraction in the main heat exchanger system.

The rectification system of the invention can be made as a classical double column system, but also as a three-column or multicolumn system. In addition to the columns for nitrogen-oxygen separation, it can have additional devices for obtaining other air components, especially rare gases. In addition to the rectification system, in the process a mixing column is used in which an oxygen-rich fraction is vaporized from rectification in direct heat exchange with a heat exchange medium. The top gas of the mixing column is used for indirect vaporization of a liquid-pressurized product fraction (so-called internal compression).

The oxygen-rich fraction which is used as the feedstock for the mixing column has an oxygen concentration which is higher than that of air and is for example 70 to 99.5% by mole, preferably 90 to 98% by mole. A mixing column is defined as a countercurrent contact column in which a more easily volatile gaseous fraction is sent opposite a more poorly volatile liquid.

The process of the invention is suitable for obtaining gaseous compressed oxygen and/or gaseous compressed nitrogen, especially for producing gaseous impure oxygen under pressure. Here impure oxygen is defined as a mixture with an oxygen content of 99.5% by mole or less, especially from 70 to 99.5% by mole. The product pressures are for example 3 to 25 bar, preferably 4 to 16 bar. Of course the compressed product if necessary can be further compressed in the gaseous state.

A process of the initially mentioned type is known from DE 19803437 A1. Here liquid oxygen is pumped and vaporized in the top condenser of the mixing column.

The object of the invention is to make the initially mentioned process economically more favorable, especially by hardware simplification and/or energy saving.

This object is achieved in that indirect heat exchange for vaporization of the liquid-pressurized product fraction is no longer done in a separate condenser-evaporator, but in the main heat exchanger system in which the pressure column air is also cooled. Preferably the product fraction is introduced immediately after pressurization rise (for example, in a pump) into the cold end of the main heat exchanger system, there first heated to the boiling point and then vaporized, both against the condensing or condensed top fraction of the mixing column.

In this way a separate condenser-evaporator which is necessary in the process from DE 19803437 A1 can be eliminated, as can a separate heat exchanger for removing the supercooling from the liquid-pressurized product fraction. By integrating the vaporization of the liquid product fraction and the cooling of air moreover the heat exchange process (Q-T diagram) can be improved so that especially small exchange losses are achieved and thus relatively low energy consumption is achieved.

The main heat exchanger system in the sense of this invention can, but need not, be implemented by a single heat exchanger block. It can also consist of several blocks connected in parallel or series. With parallel connection the blocks have the same inlet and outlet temperatures. Generally vaporization and at least part of the heating of the liquid-pressurized product flow take place in the same heat exchanger block.

The mixing column is operated under a pressure which is enough to vaporize the product fraction below the desired pressure against the condensing top gas of the mixing column, for example below 5 to 17 bar, preferably below 5 to 13 bar. The pressure of the high pressure column in the invention is in the range of for example 5 to 15 bar, preferably 5 to 12 bar, that of the low pressure column for example 1.3 to 6 bar, preferably 1.3 to 4 bar.

Preferably the top product of the mixing column downstream of the condensation which takes place in the condenser-evaporator is expanded and recycled into the low pressure column. The top product is introduced therein at a feedpoint, above by at least one theoretical plate (for example, one to ten theoretical plates) the removal point of the oxygen-rich fraction. Between the condenser-evaporator and expansion, the fluid is optionally cooled, for example by indirect heat exchange with the product fraction and/or the oxygen-rich fraction.

Preferably a second flow of purified feedstock air is compressed to a pressure which is clearly higher than the operating pressure of the pressure column, is cooled in the main heat exchanger system, and then fed into the mixing column as a heat exchange medium. This second air flow at the same time delivers at least some of the heat for heating the liquid-pressurized product fraction downstream of its vaporization. "Clearly higher" is defined here as a pressure difference which is higher than the line losses, especially higher than 1 bar. This pressure difference can be achieved for example by all the air being compressed essentially to the pressure column pressure and then its being branched into two air flows, the second flow being further compressed, for example by a motor-driven compressor. Alternatively, the two air flows can be compressed separately from the atmospheric pressure to the pressures required at the time. The pressure to which the second air flow is compressed is generally 1.1 to 2.0 times the pressure of the liquid product fraction during its vaporization.

It is furthermore favorable when the second flow after its cooling in the main heat exchanger system and before it is fed into the mixing column is further cooled in indirect heat exchange with the liquid-pressurized oxygen-rich fraction. Thus the two feedstock fractions of the mixing column are brought to the temperature which is optimum for their feed.

For optimization of the Q-T diagram of the main heat exchanger system it is advantageous if the second flow at a first intermediate point below a first intermediate temperature is removed from the main heat exchanger system, the first intermediate temperature being clearly higher than its dew point. The gaseous top product of the mixing column is introduced into the main heat exchanger system at the first intermediate point at which the second flow is removed from the main heat exchanger system. In this way the same passage in the main heat exchanger system can be used both for cooling of the second air flow and also for condensation of the top product of the mixing column.

If the compressed product is oxygen, the product fraction is removed from the low pressure column. The product fraction and the oxygen-rich fraction for the mixing column can then be jointly withdrawn from the low pressure column and/or jointly liquid-pressurized; in hardware terms this is especially simple. Alternatively, the product fraction and the oxygen-rich fraction can be removed at different points of the low pressure column. The oxygen-rich fraction is preferably withdrawn at least one theoretical or practical plate above the removal point of the product fraction from the low pressure column.

Alternatively or in addition to the compressed oxygen, nitrogen can be obtained as the compressed product. The (additional) product fraction is then removed from the pressure column, if necessary for example liquefied in the top condenser of the pressure column, liquid-pressurized separately from the oxygen-rich fraction and vaporized and heated in the main heat exchanger system.

In the lower area a liquid fraction, for example the bottom liquid, is removed from the mixing column, expanded and delivered to the pressure column or to the low pressure column. In the case of feed into the low pressure column, the feed point is preferably above the removal of the oxygen-rich fraction and the return feed of the top fraction from the mixing column, preferably one to twenty theoretical plates above the introduction of the return feed of the top fraction to the mixing column. Before expansion, the liquid fraction from the mixing column is optionally cooled, for example by indirect heat exchange with the product fraction and/or the oxygen-rich fraction.

The invention relates moreover to a device for obtaining a compressed product by low-temperature separation of air system which has a pressure column (3) and a low pressure column (4)

a. with a first feedstock air line for feeding compressed and purified feedstock air via the main heat exchanger system into the pressure column, b. with a liquid transfer line for feed of a fraction from the pressure column into the low pressure column, the liquid transfer line having an expansion means, c. with a means for increasing the pressure of the oxygen-rich fraction from the low pressure column with an outlet which is flow-connected to the mixing column, d. with a supply line for feeding the heat exchange medium into the lower area of the mixing column, e. with a top product line for removing the gaseous top product from the upper area of the mixing column, f. with means for increasing the pressure of a liquid product fraction from the rectification system with an outlet which is flow-connected to the product evaporator which is also connected to the head product line and to the compressed product line wherein g. the product evaporator is formed by the main heat exchanger system.

The invention and further details of the invention are explained below using the embodiments shown schematically in the drawings.

BRIEF DESCRIPTION OF THE DRAWINGS

For process steps or hardware which agree or correspond to one another in all drawings the same reference numbers or numbers which agree in the last two digits are used.

Figure 1:
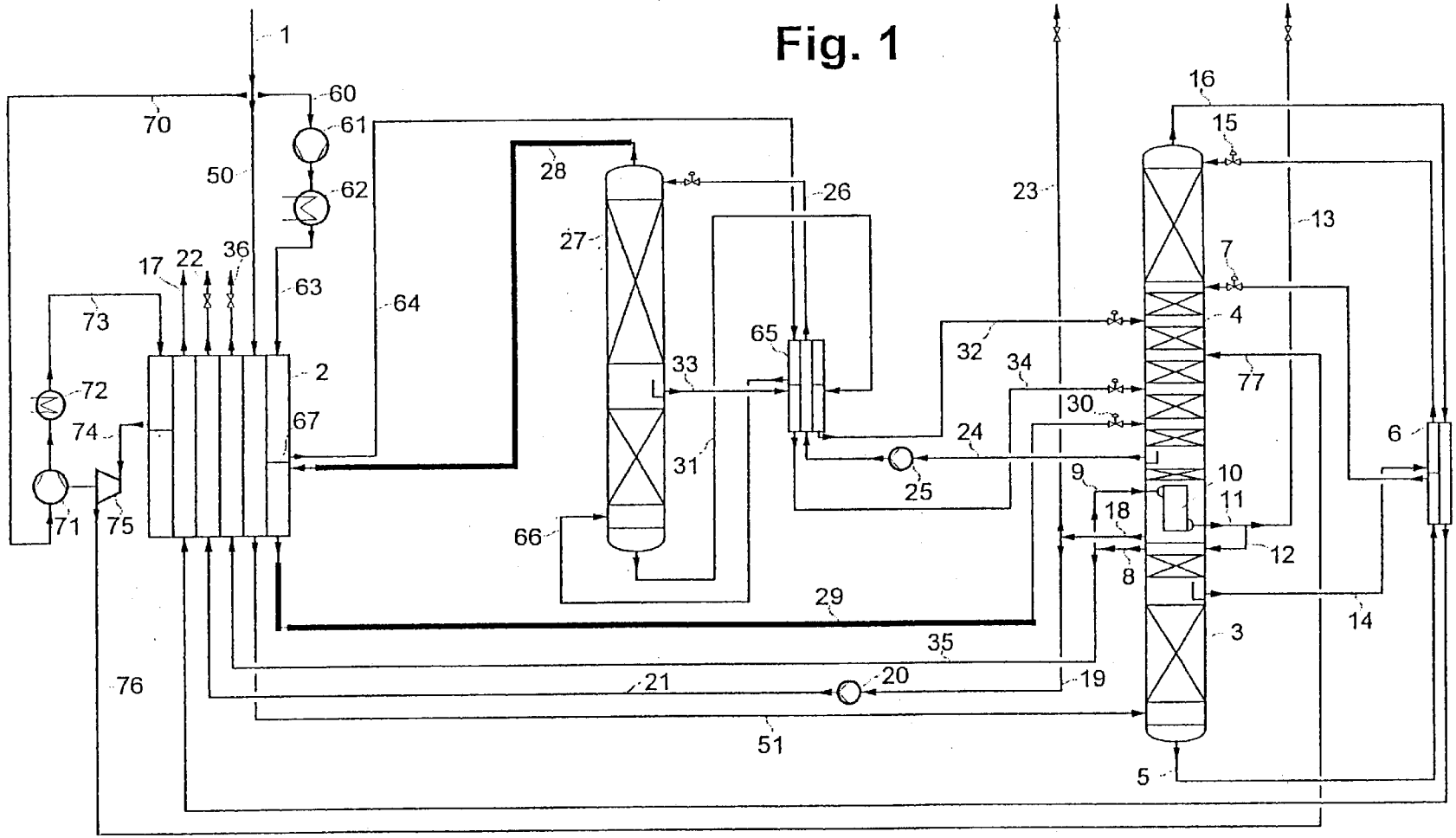
FIG. 1 shows a first embodiment of the invention with the main heat exchanger system in the form of a single block.

Compressed and purified air 1 is branched in the process shown in FIG. 1 upstream of a main heat exchanger 2 into three component flows 50, 60, 70. The air pressure at this point corresponds to the operating pressure of the pressure column 4 plus line losses.

The first air flow 50 is cooled in the main heat exchanger 2 against back flows to roughly the dew point temperature and via a line 51 fed into the lower area of a pressure column 3 without pressure-changing measures.

Raw oxygen 5 from the bottom of the pressure column 3 is, optionally after supercooling in the supercooling countercurrent heat exchanger 6—throttled (7) into the low pressure column 4. Top nitrogen 8 of the pressure column 3 is routed via the line 9 into a main condenser 10 and liquefied there against vaporizing bottom liquid of the low pressure column 4. The condensate 11 is delivered at least in part via the line 12 as reflux to the pressure column 3. Another part can be obtained as liquid nitrogen product 13.

Part 35 of the top nitrogen 8 of the pressure column 3 is routed directly to the main heat exchanger 2 and recovered as gaseous compressed nitrogen product 36.

From an intermediate point of the pressure column 3 nitrogen-rich liquid 14 is removed, supercooled in the supercooling countercurrent heat exchanger 6 and delivered via a butterfly valve 15 of the low pressure column 4 at the top as reflux.

At the top of the low pressure column 4 a nitrogen-rich residual gas 16 is withdrawn and heated to roughly ambient temperature in the heat exchangers 6 and 2. The hot residual gas 17 can be used for example as regeneration gas in a cleaning device which is not shown for the feedstock air 1.

In the bottom of the low pressure column 4 impure oxygen with an oxygen content of 95% by mole is produced. At least part 19 of the bottom liquid 18 of the low pressure column 4 forms the product fraction in the sense of the invention. It is brought by a pump 20 to roughly the product pressure of for example 7.4 bar and routed via a line 21 to the cold end of the main heat exchanger 2. There, in succession, it is heated to the boiling point, vaporized and heated to roughly ambient temperature in succession. Finally, the product fraction at 22 is withdrawn as gaseous pressurized product below the product pressure of 7.4 bar.

Another part 23 of the bottom liquid 18 of the low pressure column 4 can be obtained as liquid oxygen product.

Some (for example three theoretical) plates above the bottom of the low pressure column an oxygen-rich fraction 24 with an oxygen content of for example 88% by mole is removed liquid, pressurized in a pump 25 and after heating in 65 delivered via line 26 to the top of a mixing column 27. The operating pressure of the mixing column is for example 9.6 bar at the bottom. The gaseous top product 28 of the mixing column 27 has an oxygen content of 83% by mole and is fed into the cold part of the main heat exchanger 2. There it delivers heat for vaporization of the product flow 21 and for its heating to the boiling point. In indirect heat exchange in the main heat exchanger 2 the top product of the mixing column is condensed and supercooled. The liquid flows via the line 29 and the butterfly valve 30 back into the low pressure column 4. The feed point is roughly three theoretical plates above the point at which the oxygen-rich fraction 24 is removed.

The heat exchange medium for the mixing column 27 is formed by the second component flow 60 of feedstock air. It is brought to roughly above the mixing column pressure in a recompressor 61 (in the example driven by means of external energy) with subsequent aftercooling 62 and is routed via the line 63 to the hot end of the main heat exchanger 2. The second component flow of air is removed again from the main heat exchanger 2 at an intermediate temperature above the cold end. After further cooling in 65 it is introduced into the bottom area of the mixing column as the heat exchange medium 66. Both the bottom fraction 31/32 as well as the intermediate fraction 33/34 of the mixing column 27 are supercooled in 65 and then throttled into the low pressure column 4 at the points corresponding to their respective composition.

The same passages are used to cool the second component air flow 63 and to condense and cool the top fraction 28 in the main heat exchanger. The cold and the hot sections of these passages are separated from one another by impermeable horizontal walls (in the drawings symbolized by a single horizontal line 67). These walls (so-called sidebars) are located at the point of the intermediate temperature at which the top fraction 28 and the second air part 64 are supplied to or taken from the main heat exchanger.

To equalize the insulation and exchange losses and optionally to produce liquid products (for example, via a line 13 and/or a line 23) cold is produced by work-performing expansion of one or more process flows. In the embodiment of FIG. 1 for this purpose a third part 70/73 of the feedstock air at an intermediate temperature is routed out (74) of the main heat exchanger 2 and expanded in a turbine 75 to 1.4 bar, performing work. To increase the cold output or to reduce the amount of turbine air the air 70 from the work-performing expansion can be recompressed (71) to a pressure of for example 8 bar. The recompressor 71 in the example is driven by the mechanical energy produced in the turbine 75, preferably by direct mechanical coupling of the turbine 75 and the recompressor 71. The compression heat is removed by indirect heat exchange with a coolant in the aftercooler 72. The air 76, 77 which has been expanded to perform work is fed directly into the low pressure column 4.

Figure 1A:
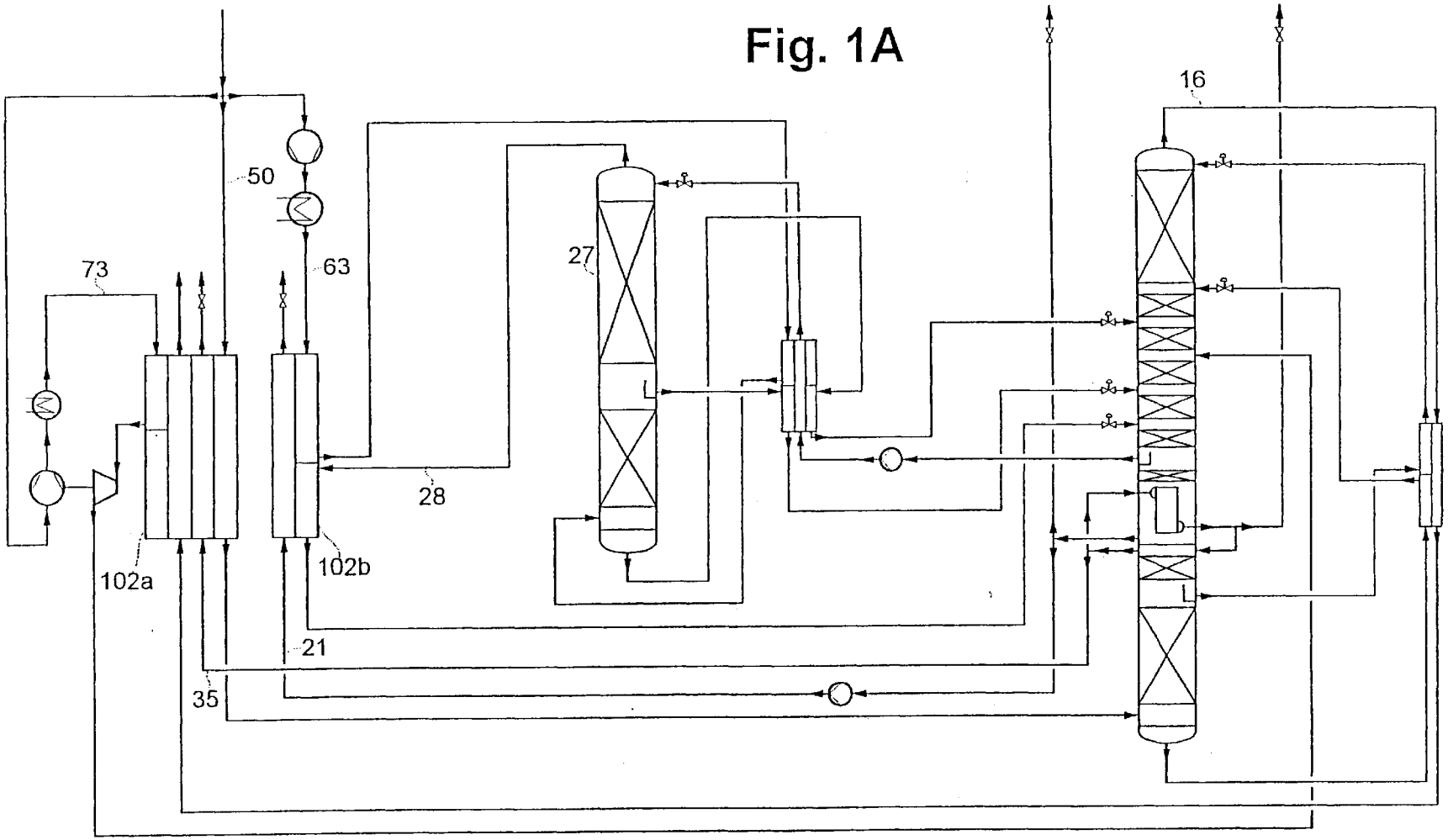
FIG. 1A shows a version of FIG. 1 in which the main heat exchanger system is formed by two parallel blocks.

In FIG. 1 the main heat exchanger system in the sense of the invention is formed by a single block 2 which was called the main heat exchanger above. In contrast, in the process which is shown in FIG. 1A, the main heat exchanger system is formed by two separate blocks 102, 102*b*. In 102*a,* the main heat exchanger in the narrower sense, the gaseous product flows 35, 16 are heated against the first and third air flow 50, 73. In the oxygen heat exchanger 102*b* solely the liquid product flow is heated and vaporized, in countercurrent to the top fraction 28 of the mixing column 27 and to the second air flow 63.

The procedure from FIG. 1A is more favorable in terms of hardware because only the oxygen heat exchanger 102*b* need be designed for the high pressure of the second component flow 63 of air. This approach-is recommended for smaller plants. Complete integration of the two heat exchange processes as shown in FIG. 1 is more favorable in terms of energy and is thus more advantageous for larger plants.

Figure 2:
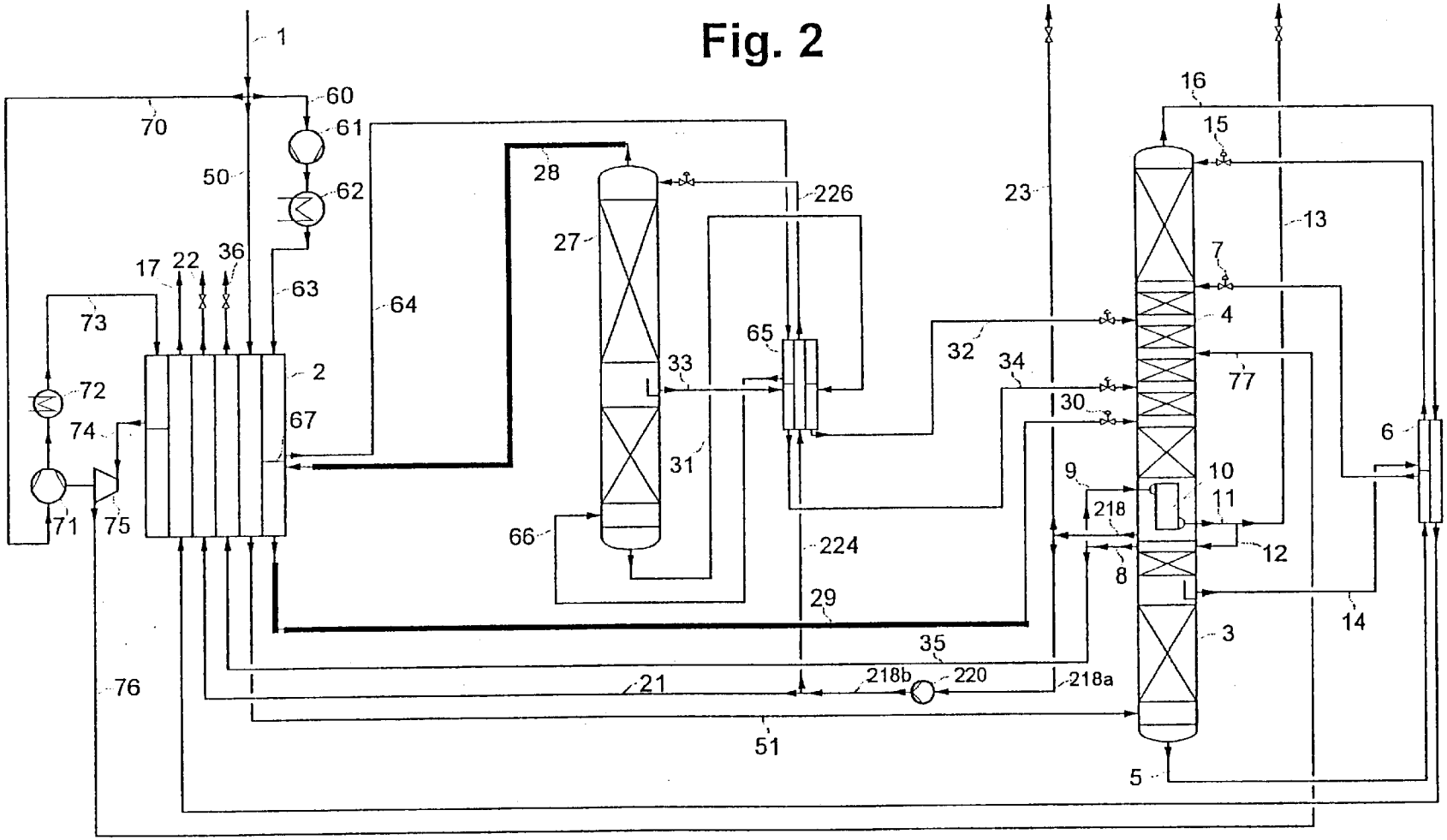
FIG. 2 shows another version of FIG. 1, in which only one pump is needed.

The process from FIG. 2 differs from the process shown in FIG. 1 by saving one pump (25 in FIG. 1). This is done by withdrawing (218, 218*a*) the product fraction 21 and the oxygen-rich fraction 224/226 jointly from the bottom of the low pressure column 4 and pressurizing them in a pump 220. The high pressure liquid 218*b* is then divided into a product flow 21 and feedstock liquid 224 for the mixing column 27. (The apparatus which are shown in the drawings as individual pumps are generally made as a pair of pumps for redundancy purposes).

Figure 3:
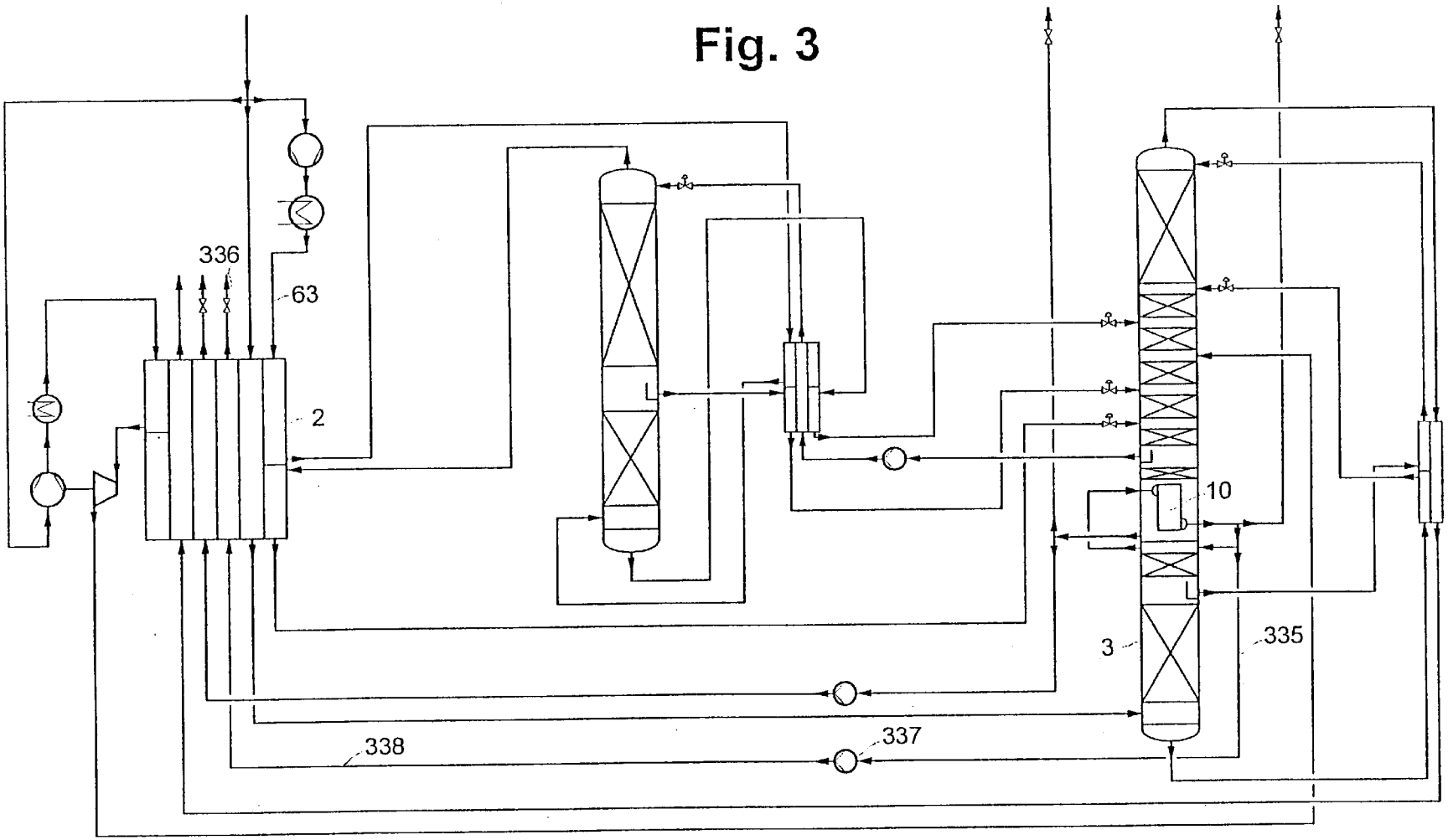
FIG. 3 shows a fourth embodiment in which in addition to oxygen also nitrogen is internally compressed.

FIG. 3 likewise agrees for the most part with FIG. 1. In this process, however, the gaseous compressed nitrogen product 336 is obtained at a higher pressure which is clearly above the operating pressure of the pressure column 3. The line 335 is connected to the outlet and not the inlet (see 35 in FIG. 1) of the main condenser 10. The liquid nitrogen 335 is brought to the required product pressure (for example, 6 to 25 bar) in another pump 337 and heated and vaporized in the main heat exchanger 2. To do this of course the other flows must be adapted accordingly, especially the amount of high pressure air 63 compared to FIG. 1 must be increased. Thus, with the process as claimed in the invention nitrogen can be produced under high pressure more economically without an additional gas compressor.

Figure 4:
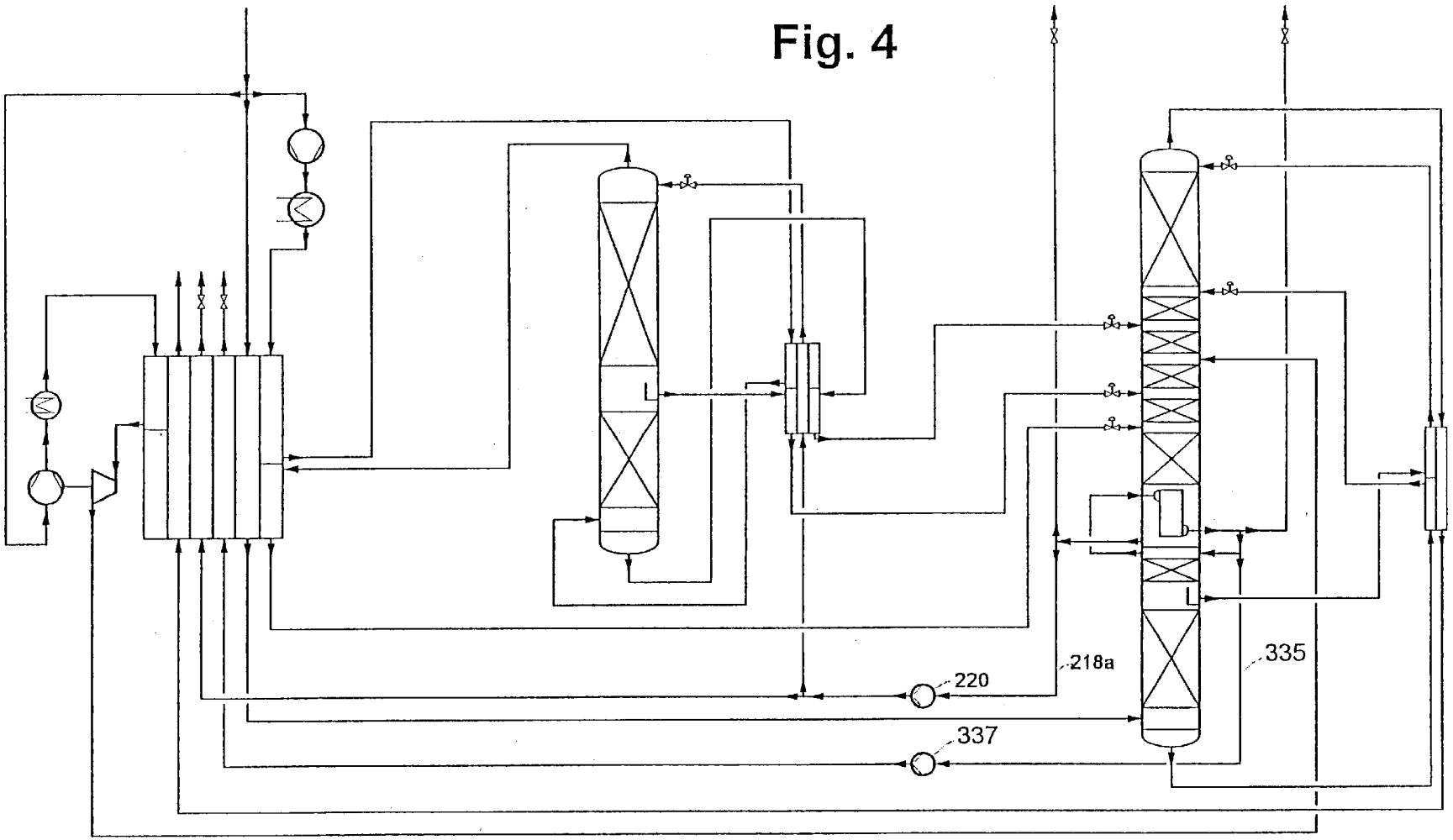
FIG. 4 shows a process which combines aspects of FIGS. 2 and 3, FIGS. 5 to 8 show other embodiments which are especially suited for obtaining argon.

Compressed nitrogen production 335, 337 as shown in FIG. 3 is combined in FIG. 4 with the joint compression 218*a,* 220 of the oxygen-rich fraction and product fraction. In one version of the process from FIG. 4 the internal nitrogen compression 335/337 is carried out without internal oxygen compression, i.e. the pump 220 is used only to deliver liquid to the top of the mixing column and not to produce a gaseous oxygen product.

Figure 5:
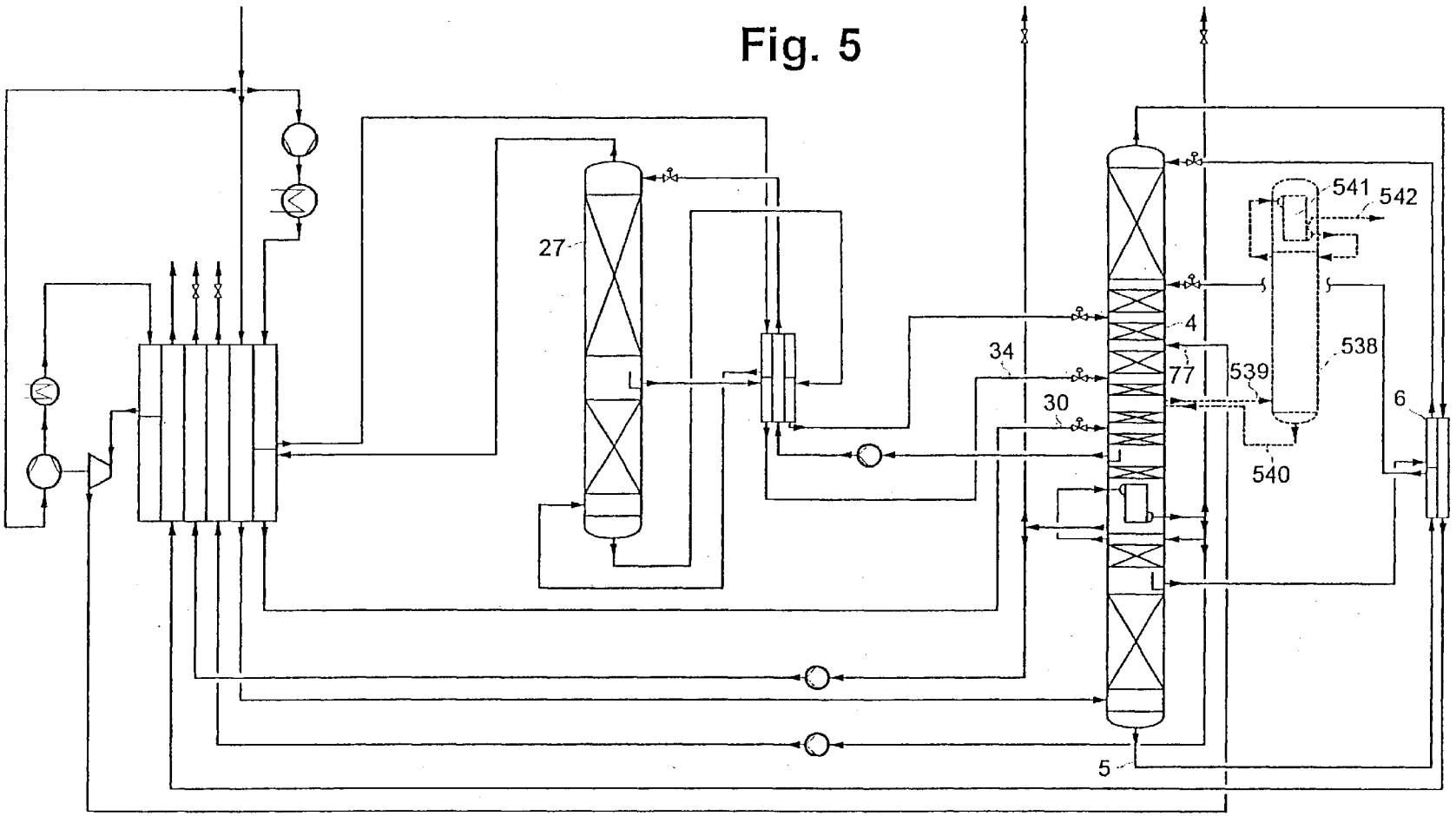

The process of the invention is suited not only for obtaining impure oxygen, but also allows product purities of 98% by mole or more (for example 98 to 99.9%, preferably 98 to 99.5%) in the oxygen product 22. In this-case argon production can be connected, as shown in FIG. 5. Here a conventional raw argon column 538 is connected to an intermediate point of the low pressure column (539, 540). The argon transition 539/540 is between the feed points of the two liquids 30, 34 from the mixing column 27. The top condenser 541 of the raw argon column can be operated, as usual, with raw oxygen 5 downstream of the supercooling 6 (not shown). The raw argon product 542 is preferably further purified, for example in a pure argon column which is likewise not shown.

Figure 6:
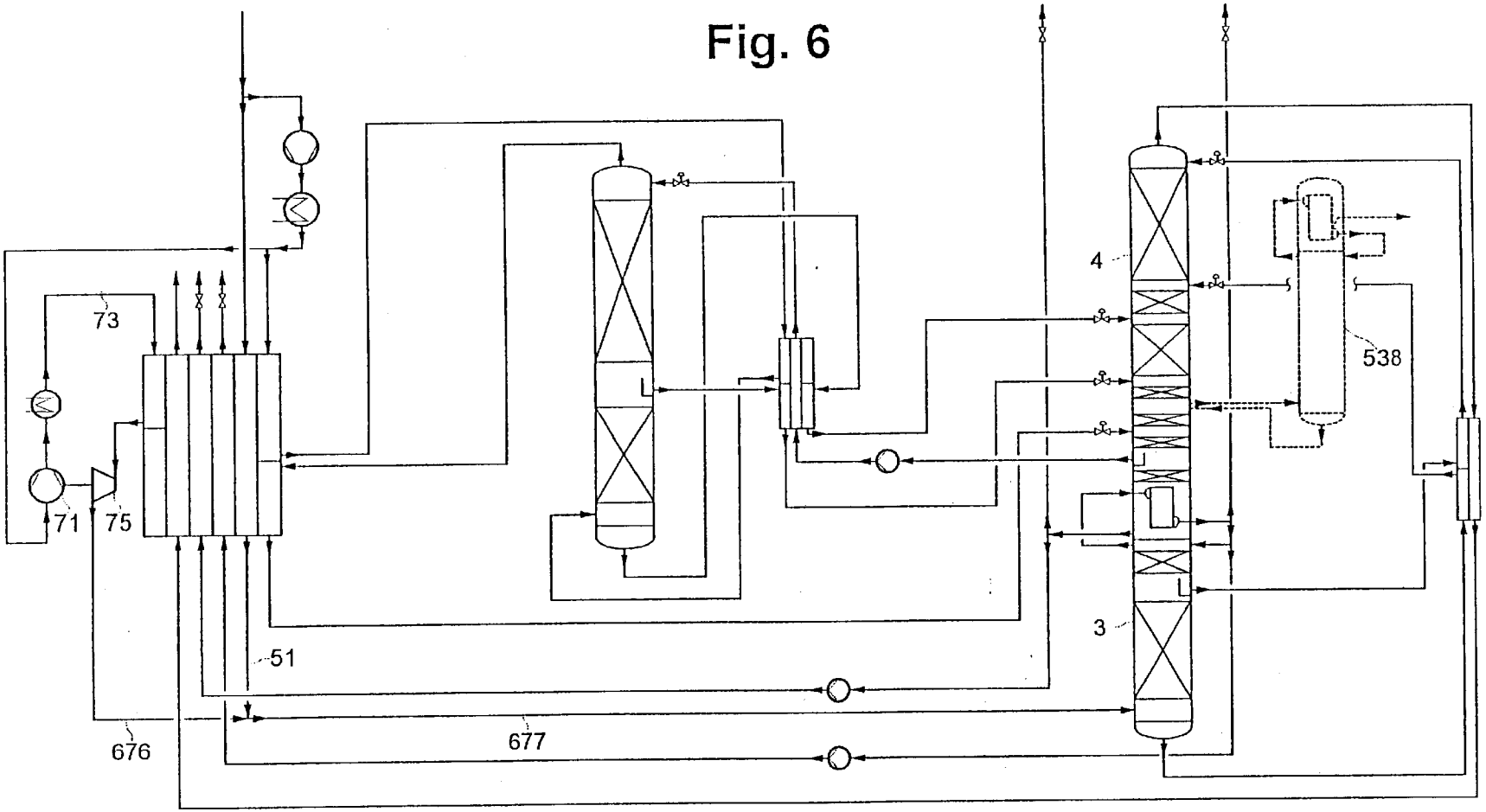

To increase the argon yield, it is possible to eliminate direct introduction of air into the low pressure column 4 (77 in FIG. 5) by expanding the third component flow 73 of the feedstock air in the turbine 75 to roughly the operating pressure of the pressure column 3, as shown in FIG. 6. The turbine exhaust gas 676 is then supplied (677) to the pressure column 3, in the example jointly with the direct air (first component flow 51 of air).

Figure 7:
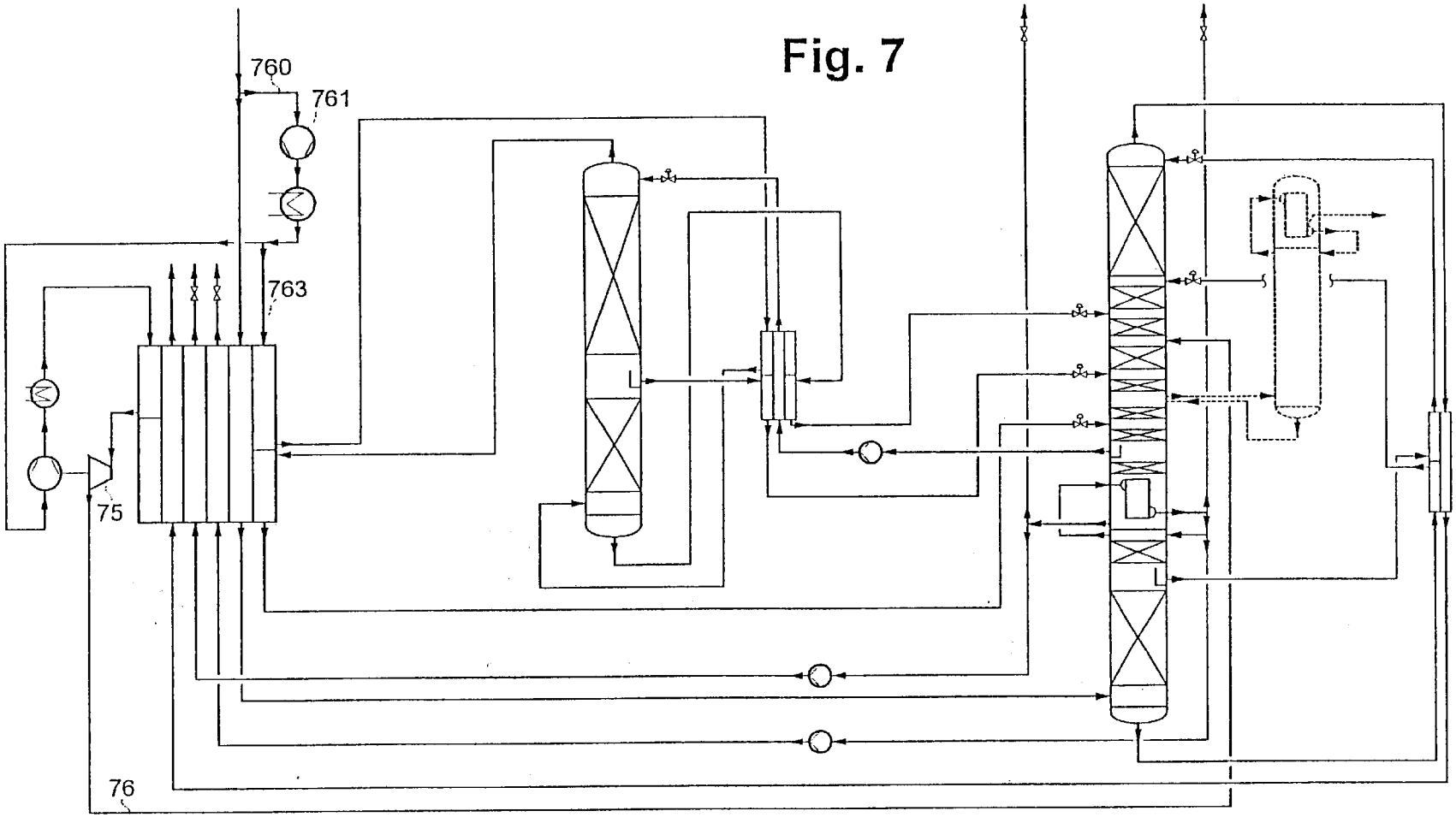

If the cold output achieved in FIG. 6 is not enough, the pressure ratio on the turbine 75 must be increased. As shown in FIG. 7, this can be done without using an additional machine by using the externally driven recompressor for the mixing column air 763 in addition for increasing the pressure in the turbine air 770. The turbine 75 expands in the example to the low pressure column pressure, thus especially high liquid production is possible.

Figure 8:
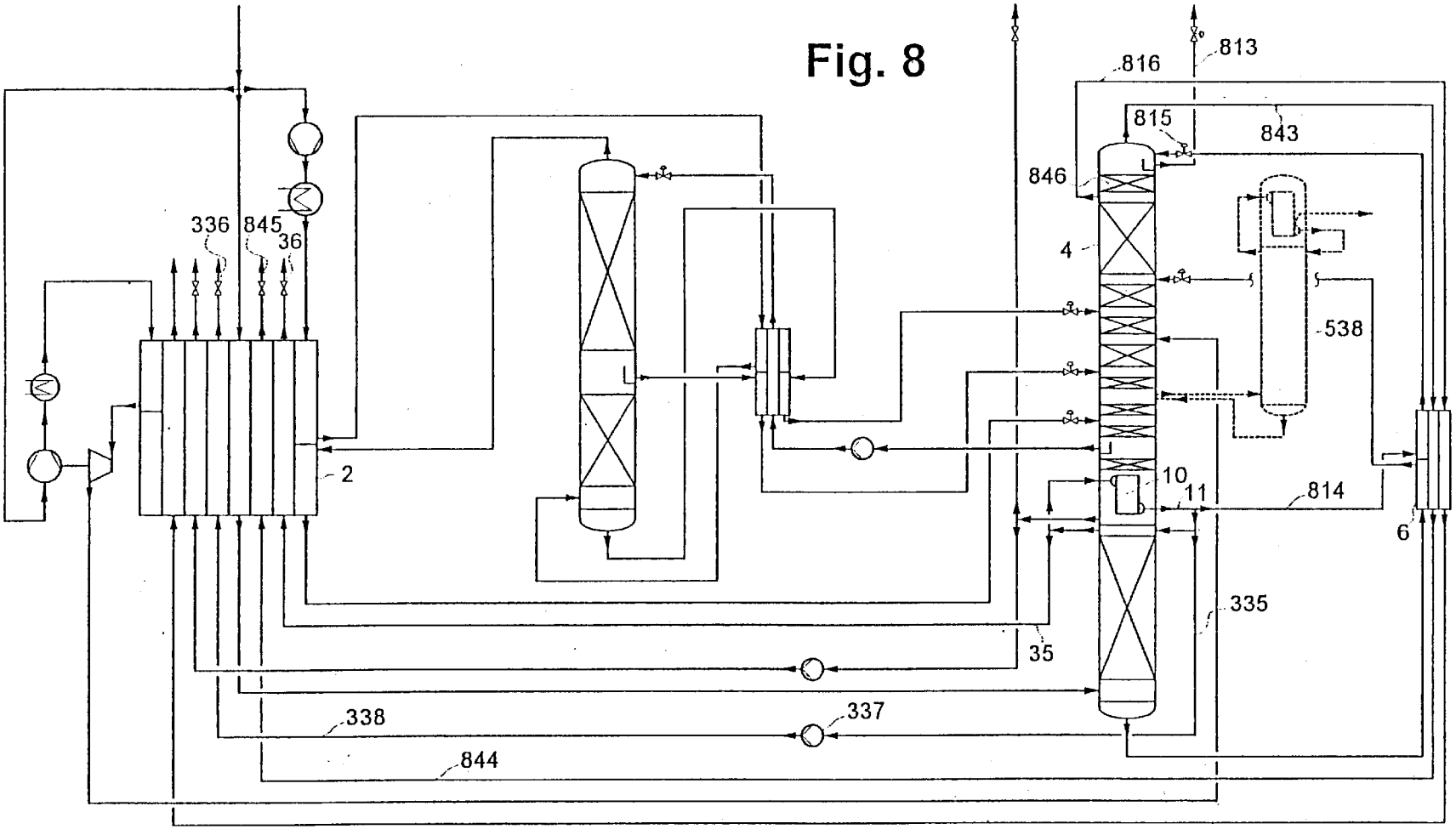

In FIG. 8 pure nitrogen 843–844–845 is also obtained in the low pressure column 4. To do this, part 814 of the liquid nitrogen 11 from the main condenser 10 is supercooled in 6 and delivered via a butterfly valve 815 as reflux to the low pressure column 4. (The intermediate discharge point 14 shown in the other embodiments on the pressure column can be omitted here). Impure nitrogen (nitrogen-rich residual gas) 816 is removed from the intermediate point of the low pressure column underneath the pure nitrogen section 846.

The liquid nitrogen product 813 is withdrawn from the low pressure column 4 in FIG. 8. Moreover, the methods for obtaining compressed nitrogen of FIG. 1 (35–36) and FIG. 3 (335–337–338–336) are implemented at the same time. Thus gaseous nitrogen (845, 36, 336) can be made available under a total of three different pressures without an additional gas compressor having to be used.

The special measures of FIGS. 6 to 8 can also be used fundamentally without argon recovery (raw argon column 538).

The following numerical examples in Tables 1 and 2 relate to the embodiment from FIG. 2. They relate to two design cases with different purity of the oxygen product.

TABLE 1

| | No. | Amount in $Nm^3/h$ | Pressure in bar | Temperature in K | $O_2$content in % by mole |
|---|---|---|---|---|---|
| total air | 1 | 183117 | 5.40 | 290.0 | 20.95% |
| 1. 1st component flow before feed into the pressure column | 51 | 113445 | 5.32 | 101.9 | 20.95% |
| 2. 2nd component flow upstream of the main heat exchanger system | 63 | 53540 | 9.60 | 290.0 | 20.95% |
| 2. component flow upstream of mixing column | 66 | 53540 | 9.52 | 107.6 | 20.95% |
| 3. 3rd component flow upstream of turbine | 74 | 15971 | 7.68 | 142.8 | 20.95% |
| 3. 3rd component flow downstream of turbine | 76 | 15971 | 1.40 | 92.8 | 20.95% |
| bottom liquid of mixing column | 31 | 32774 | 9.51 | 107.4 | 37.79% |
| intermediate liquid of mixing column | 33 | 53304 | 9.51 | 111.0 | 61.84% |
| oxygen upstream of the pump | 218a | 77569 | 1.40 | 92.6 | 95.00% |
| oxygen downstream of the pump | 218b | 77569 | 11.00 | 93.3 | 95.00% |
| oxygen-rich fraction upstream of the mixing column | 226 | 77569 | 10.89 | 116.9 | 95.00% |
| oxygen product | 22 | 38000 | 7.38 | 287.3 | 95.00% |
| compressed nitrogen product | 36 | 1 | 5.16 | 287.3 | 0.95% |

TABLE 1-continued

| | No. | Amount in $Nm^3/h$ | Pressure in bar | Temperature in K | $O_2$content in % by mole |
|---|---|---|---|---|---|
| residual gas | 17 | 22001 | 1.24 | 287.3 | 1.54% |
| liquid nitrogen product | 13 | 1 | 1.39 | 80.3 | 2.28% |
| liquid nitrogen product | 23 | 1 | 1.35 | 91.0 | 95.00% |

TABLE 2

| | No. | Amount in $Nm^3/h$ | Pressure in bar | Temperature in K | $O_2$content in % by mole |
|---|---|---|---|---|---|
| total air | 1 | 202839 | 5.40 | 290.0 | 20.95% |
| 1. 1st component flow before feed into the pressure column | 51 | 128022 | 5.32 | 108.8 | 20.95% |
| 2. 2nd component flow upstream of the main heat exchanger system | 63 | 58713 | 18.30 | 290.0 | 20.95% |
| 2. component flow upstream of mixing column | 66 | 58713 | 18.22 | 118.2 | 20.95% |
| 3. 3rd component flow upstream of turbine | 74 | 15943 | 8.80 | 179.8 | 20.95% |
| 3. 3rd component flow downstream of turbine | 76 | 15943 | 1.39 | 113.7 | 20.95% |
| bottom liquid of mixing column | 31 | 39656 | 18.01 | 118.0 | 33.00% |
| intermediate liquid of mixing column | 33 | 57370 | 18.01 | 123.0 | 61.09% |
| oxygen upstream of the pump | 218a | 84828 | 1.40 | 92.8 | 90.50% |
| oxygen downstream of the pump | 218b | 84828 | 19.00 | 94.2 | 90.50% |
| oxygen-rich fraction upstream of the mixing column | 226 | 84828 | 18.89 | 130.0 | 90.50% |
| oxygen product | 22 | 38000 | 14.88 | 287.0 | 99.35% |
| compressed nitrogen product | 36 | 1 | 5.16 | 287.0 | 2.40% |
| residual gas | 17 | 22001 | 1.24 | 287.0 | 2.86% |
| liquid nitrogen product | 13 | 1 | 1.39 | 80.5 | 5.71% |
| liquid nitrogen product | 23 | 1 | 1.35 | 91.0 | 90.50% |

Figure 9:
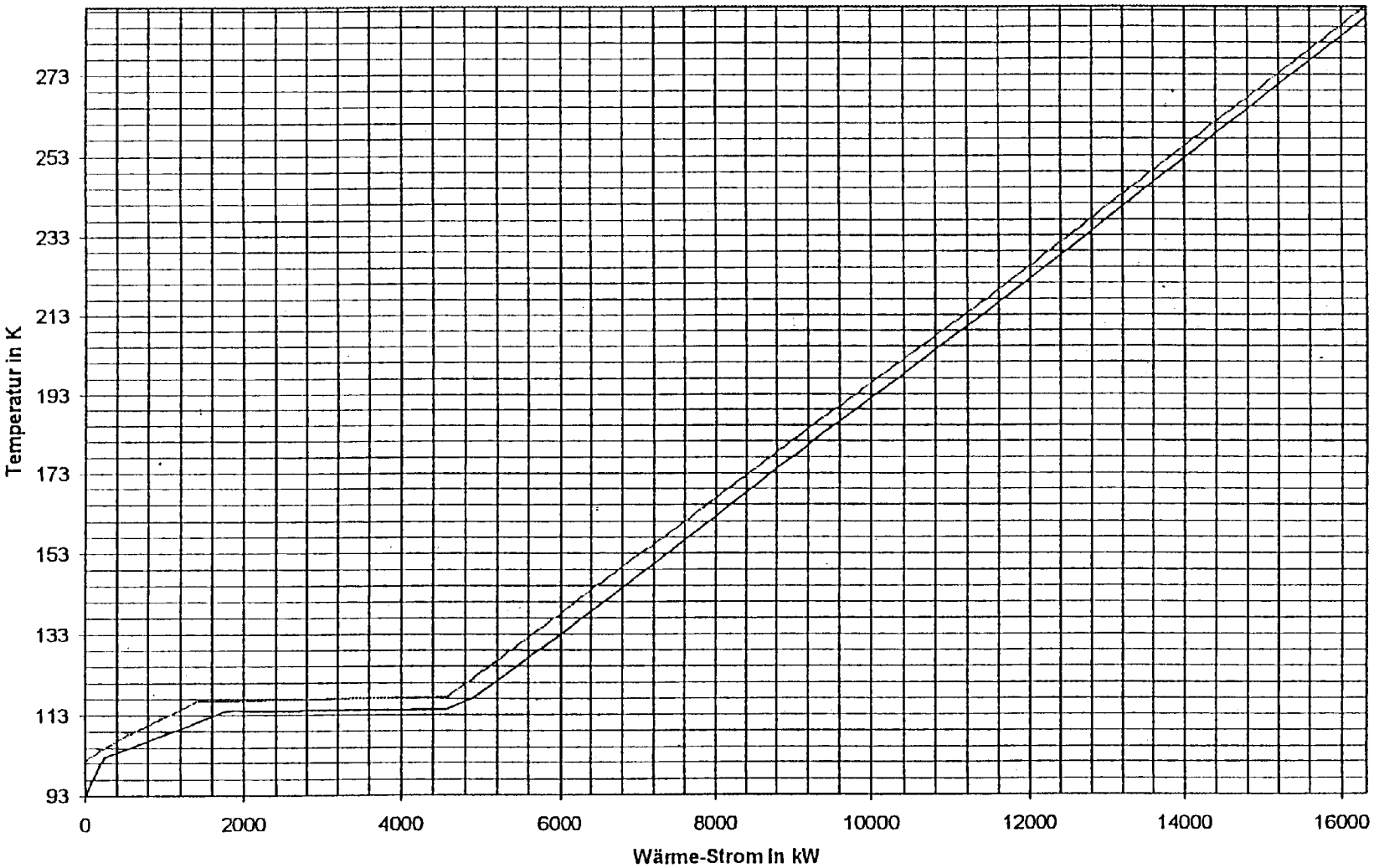
FIG. 9 shows the Q-T diagram for the embodiment of FIG. 2.

FIG. 9 shows the heat exchange diagram (Q-T diagram) for the main heat exchanger system 2 of the process as shown in FIG. 2 (Table 1).

The preceding examples can be repeated with similar success by substituting the generically or specifically described reactants and/or operating conditions of this invention for those used in the preceding examples.

The entire disclosure of all applications, patents and publications, cited above and below, and of corresponding German Application No. 101 39 727.5, filed Aug. 13, 2001 is hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process for obtaining a compressed product (22; 336) by low temperature separation of air in a rectification system which has a pressure column (3) and a low pressure column (4), wherein:

a. a first flow (50) of compressed and purified feedstock air (1) is cooled in a main heat exchanger system (2; 102*a*, 102*b*) and is fed (51, 677) into the pressure column (3), b. at least one fraction (5) from the pressure column (3) is expanded (7) and fed into the low pressure column (4), c. an oxygen-rich fraction (24; 218*a*) from the low pressure column (4) is liquid-pressurized (25; 220) and delivered (28; 224, 226) to a the mixing column (27), d. a heat exchange medium (66) is fed into the lower area of the mixing column (27) and is brought into countercurrent contact with the oxygen-rich fraction (26; 226), e. a gaseous top product (28) is removed from the upper area of the mixing column (27) and f. a product fraction (19; 218*a*; 335) is removed from the rectification system, liquid-pressurized (20; 220; 337), vaporized in indirect heat exchange (2, 102*b*) with the gaseous top product (28) of the mixing column (27) and is withdrawn as the compressed product (22; 336), and g. indirect heat exchange is carried out for vaporization of the liquid-pressurized product fraction (21) in the main heat exchanger system (2; 102*a*, 102*b*).

2. A process as claimed in claim 1, wherein a second flow (60, 760) of purified feedstock air (1) is compressed (61, 761) to a pressure which is clearly higher than the operating pressure of the pressure column (3), cooled in the main heat exchanger system (2, 102*a*, 102*b*) and then fed as said heat exchange medium (64, 66) into the mixing column (27).

3. A process as claimed in claim 2, wherein the second flow (64), after its cooling in the main heat exchanger system (2; 102*a*, 102*b*) and prior to its feed into the mixing column (27), is further cooled by in indirect heat exchange (65) with the liquid-pressurized, oxygen-rich fraction (24; 224) is further cooled.

4. A process as claimed in claim 2, wherein the second flow (64) is removed from the main heat exchanger system (2, 102*a*, 102*b*) at a first intermediate point (67) below a first intermediate temperature, the first intermediate temperature being higher than the dew point of the second flow.

5. A process as claimed in claim 4, wherein the gaseous top product (28) of the mixing column (27) is introduced into the main heat exchanger system (2; 102, 102*b*) at the first intermediate point (67) at which the second flow (64) is removed from the main heat exchanger system.

6. A process as claimed in claim 1, wherein the product fraction (19, 21) is removed (18; 218) from the low pressure column (4).

7. A process as claimed in claim 6, wherein the product fraction (21) and the oxygen-rich fraction (224) are withdrawn jointly from the low pressure column (4) and are jointly liquid-pressurized (220).

8. A process as claimed in claim 6, wherein the oxygen-rich fraction (24) is withdrawn at least one theoretical or practical plate above the removal point of the product fraction (18, 19) from the low pressure column (4).

9. A process as claimed in claim 1, wherein the product fraction or another product fraction (335; 35) is removed from the pressure column (4).

10. An apparatus for obtaining a compressed product (22; 336) by low temperature separation of air, comprising:

a. a rectification system which has a pressure column (3) and a low pressure column (4)

b. a first feedstock air line (1, 50, 51, 677) for feeding compressed and purified feedstock air via a main heat exchanger system (2; 102*a*, 102*b*) into the pressure column (3), c. a liquid transfer line (5) for feeding a fraction from the pressure column (3) into the low pressure column (4), the liquid transfer line having an expansion means (7), d. means (25; 220) for increasing the pressure of an oxygen-rich fraction (24; 218*a*) removed from the low pressure column (4) with an outlet which is flow-connected (26; 218*b*, 224, 226) to the mixing column (27), e. a supply line (66) for feeding the heat exchange medium into the lower area of a the mixing column (27), f. a top product line (28) for removing the gaseous top product from the upper area of the mixing column (27), and g. means (20; 220; 337) for increasing the pressure of a liquid product fraction (19; 218*a*; 335) removed from the rectification system with an outlet which is flow-connected to the product evaporator (2, 102*b*), which is also connected to the top product line (28) and to a compressed product line (22; 336)

wherein the product evaporator is formed by the main heat exchanger system (2; 102*a*, 102*b*) which provides indirect heat exchange between the liquid fraction (19) and the gaseous top product to vaporize the liquid product fraction (19).

11. A process as claimed in claim 3, wherein the second flow (64) is removed from the main heat exchanger system (2, 102*a*, 102*b*) at a first intermediate point (67) below a first intermediate temperature, the first intermediate temperature being higher than the dew point of the second flow.

12. A process as claimed in claim 11, wherein the gaseous top product (28) of the mixing column (27) is introduced into the main heat exchanger system (2; 102, 102*b*) at the first intermediate point (67) at which the second flow (64) is removed from the main heat exchanger system.

13. A process as claimed in claim 2, wherein the product fraction (21) and the oxygen-rich fraction (224) are withdrawn jointly from the low pressure column (4) and are jointly liquid-pressurized (220).

14. A process as claimed in claim 3, wherein the product fraction (21) and the oxygen-rich fraction (224) are withdrawn jointly from the low pressure column (4) and are jointly liquid-pressurized (220).

15. A process as claimed in claim 4, wherein the product fraction (21) and the oxygen-rich fraction (224) are withdrawn jointly from the low pressure column (4) and are jointly liquid-pressurized (220).

16. A process as claimed in claim 5, wherein the product fraction (21) and the oxygen-rich fraction (224) are withdrawn jointly from the low pressure column (4) and are jointly liquid-pressurized (220).

17. A process as claimed in claim 11, wherein the product fraction (21) and the oxygen-rich fraction (224) are withdrawn jointly from the low pressure column (4) and are jointly liquid-pressurized (220).

18. A process as claimed in claim 12, wherein the product fraction (21) and the oxygen-rich fraction (224) are withdrawn jointly from the low pressure column (4) and are jointly liquid-pressurized (220).

19. A process according to claim 1, wherein the gaseous top product (28) of the mixing column (27) is cooled in the main heat exchanger system (2; 102, 102*b*) and then introduced into the low pressure column (4).

20. A process according to claim 1, wherein a gaseous nitrogen fraction (8) is removed from the top of the pressure column 3 and introduced into a main condenser 10 and liquefied there against vaporizing bottom liquid of the low pressure column (4), at least part of the resultant condensate (11) is introduced as reflux into the pressure column 3, and, optionally, another part of the resultant condensate (11) is obtained as liquid nitrogen product (13).

21. A process according to claim 1, wherein a gaseous nitrogen fraction (8) is removed from the top of the pressure column 3 and introduced into a main condenser 10 and liquefied there against vaporizing bottom liquid of the low pressure column (4), and at least part of the resultant condensate (11) is pressurized and heated and vaporized in the main heat exchanger (2).

22. A process according to claim 7, wherein a gaseous nitrogen fraction (8) is removed from the top of the pressure column 3 and introduced into a main condenser 10 and liquefied there against vaporizing bottom liquid of the low pressure column (4), at least part of the resultant condensate (11) is introduced as reflux into the pressure column 3, and, optionally, another part of the resultant condensate (11) is obtained as liquid nitrogen product (13).

23. A process according to claim 7, wherein a gaseous nitrogen fraction (8) is removed from the top of the pressure column 3 and introduced into a main condenser 10 and liquefied there against vaporizing bottom liquid of the low pressure column (4), and at least part of the resultant condensate (11) is pressurized and heated and vaporized in the main heat exchanger (2).

24. A process according to claim 1, wherein a bottom fraction (31/32) and an intermediate fraction (33/34) are removed from the mixing column (27), cooled by heat exchange (65) with the liquid-pressurized oxygen-rich fraction (24; 218*a*) from the low pressure column (4), throttled, and introduced into the low pressure column (4).

25. A process according to claim 24, wherein a raw argon column (538) is connected to an intermediate point of the low pressure column (539, 540) the feed points of the bottom fraction (31/32) and an intermediate fraction (33/34) from the mixing column (27) into the low pressure column (4).

26. A process according to claim 1, wherein said main heat exchange system (102*a*, 102*b*) comprises a first heat exchange block (102*a*) and a second heat exchange block, separate from said first heat exchange block (102*b*), wherein in said first heat exchange block (102*a*) a gaseous nitrogen product flow (35) from said pressure column (3) and a nitrogen-rich residual gas (16) from said low pressure column (4) are heated by heat exchange with said first flow of compressed and purified feedstock air (50), and in said second heat exchanger (102*b*) the liquid-pressurized product fraction is heated and vaporized by countercurrent indirect heat exchange with said gaseous top fraction (28) from said mixing column (27) and with a second flow of compressed and purified feedstock air (63).

* * * * *

UNITED STATES PATENT AND TRADEMARK OFFICE

CERTIFICATE OF CORRECTION

PATENT NO. : 6,662,595 B2
DATED : December 16, 2003
INVENTOR(S) : Horst Corduan et al.

It is certified that error appears in the above-identified patent and that said Letters Patent is hereby corrected as shown below:

Column 10,
Line 16, reads “the heat” should delete -- the --
Line 17, reads “of a the” should delete -- the --

Signed and Sealed this

Seventh Day of September, 2004

JON W. DUDAS
*Director of the United States Patent and Trademark Office*